US005115491A

United States Patent [19]

Perlman et al.

[11] Patent Number: 5,115,491

[45] Date of Patent: May 19, 1992

[54] TEMPERING SYSTEM FOR STORAGE TANK WATER HEATERS UTILIZING INLET AND OUTLET HEAT EXCHANGER

[76] Inventors: Maier Perlman, 344 York Hill Blvd., Thornhill, Canada, L4J 3B6; James M. Bell, 1049 Albertson Cresc., Mississauga, Ont, Canada, L5H 3C6; Colin A. McGugan, 866 Ribston Road, Mississauga, Ontario, Canada, L4Y 1B1

[21] Appl. No.: 627,865

[22] Filed: Dec. 17, 1990

[51] Int. Cl.[5] ..... H05B 3/78; F24H 1/20

[52] U.S. Cl. ..... 392/454; 126/362; 137/340; 137/341; 165/103

[58] Field of Search ..... 392/454, 341, 496; 126/362, 361; 122/20 B, 19, 13 R, 4 A; 236/20 R; 237/8 A, 8 D, 19; 165/100-101, 103; 4/194; 137/340-341

[56] References Cited

U.S. PATENT DOCUMENTS

| | | | |
|---|---|---|---|
| 1,651,692 | 12/1927 | Geaslen | 126/362 |
| 3,007,470 | 11/1961 | Haeger . | |
| 3,111,942 | 11/1963 | Miller . | |
| 3,212,566 | 10/1965 | Karassik et al. | 165/66 |
| 3,213,929 | 11/1965 | Marshall et al. | 236/12.11 |
| 3,688,839 | 9/1972 | Kirschner . | |
| 3,770,197 | 11/1973 | Meier . | |
| 3,891,817 | 6/1975 | Brown . | |
| 3,958,555 | 5/1976 | Horne . | |
| 4,412,826 | 11/1983 | DeGrose . | |
| 4,498,622 | 2/1985 | Harnish | 126/362 |
| 4,554,688 | 11/1985 | Puccerella | 4/605 |
| 4,601,263 | 7/1986 | Shieh | 122/4 A |
| 4,818,845 | 4/1989 | Koizumi et al. . | |

FOREIGN PATENT DOCUMENTS

| | | | |
|---|---|---|---|
| 188815 | 2/1957 | Australia . | |
| 62-245040 | 10/1987 | Japan | 126/362 |
| 1406428 | 3/1988 | U.S.S.R. . | |

OTHER PUBLICATIONS

Alfa-Laval Brazed Heat Exchanger Model CB25 (1989).

*Primary Examiner*—Bruce A. Reynolds
*Assistant Examiner*—John A. Jeffery
*Attorney, Agent, or Firm*—Ridout & Maybee

[57] ABSTRACT

A fluid tampering system for use with a standard water heater storage tank includes a heat exchanger which interposed between the outlet means for conveying heated fluid from the storage tank to a distribution system and the cold fluid inlet means, so that heat energy is transferred between heated fluid exiting and cold water entering the storage tank. Preferably, the heat exchange is complete and water exiting the heat exchanger in both the inlet and outlet conduits are of about equal temperature. In order to avoid the water exiting the water heater to the distribution system becoming too tepid, a bypass conduit either in the inlet means or in the outlet means may be provided triggered by a bypass valve located in the outlet conduit. As a safety feature, a safety shut-off valve is located in the outlet conduit before the distribution system to automatically shut-off the conduit where water exiting the system is above a desired maximum temperature. In this system, the water in the water storage tank may be kept at scalding temperature since it will be tempered on leaving the storage tank before entering the water distribution system to avoid scalding the user.

18 Claims, 8 Drawing Sheets

TEMPERING SYSTEM FOR STORAGE TANK WATER HEATERS UTILIZING INLET AND OUTLET HEAT EXCHANGER

BACKGROUND OF THE INVENTION

1. Field of the Invention

The present invention is directed to a modified water heater system that delivers tempered water or other fluid to the user.

2. Description of the Related Art

In conventional water heating systems, cold water, delivered to a combined water heater/storage tank, is heated to a desired temperature in readiness for demand draw by the user/consumer.

In a direct demand system, such as is commonly used for domestic hot water supply, the apprehension of scalding the user generally results in fixing the maximum temperature to which water may be heated in the water heater tank, to a relatively low setting at or below 60° C. (140° F.).

However, such tepid water temperature in a stored body of water, can encourage bacterial growth. It would therefore be preferable, for sanitary purposes, if the water in the tank was heated to sanitizing temperatures to destroy bacteria or other potential growth organisms.

In Heeger U.S. Pat. No. 3,007,470, this problem is addressed, in an industrial setting, by providing a water storage tank separate from the main water heater/storage tank, in which heat energy is simply allowed to dissipate so that temperate water is available for demand draw. The temperature of water in the temperate water storage tank is kept above a fixed minimum by actively exchanging water with the water heater/storage tank on a signal received from a temperature sensing device. However, no means are provided to actively temper the water in the storage tank for direct consumption, and therefore, scalding water may find its way to the user in a continuous demand situation.

In Horne U.S. Pat. No. 3,958,555, several different embodiments of a hot water distribution system are disclosed, including a multiple shower hook-up in which a blending valve allows cold water to mix with hot water from the hot water heater/storage tank. The blended water enters a pump-activated recirculation pipeline passing the shower/discharge outlets, and unused tempered water may either be passed through a heat exchanger to restore heat energy dissipated while recirculating, or may bypass the valve blending in cold water to avoid further cooling. However, this system is complex, requiring an additional cold water inlet at the blending valve and an entire pump-activated recirculation system ancillary to the basic hot water system.

OBJECTS OF THE INVENTION

It is therefore an object of the present invention to provide a tempering system for storage tank water heaters which will allow water to be stored in the tank at high temperatures for demand management purposes and bacterial growth control, but will supply water to the user at tempered temperatures to reduce scalding hazards.

It is a further object of this invention to provide a system in which water is maintained at scalding temperatures in an insulated storage tank, to reduce re-heating demands, especially during peak energy demand periods, but to prevent scalding water from reaching the user.

It is a further object of the present invention to provide a water tempering system which can be used to modify existing conventional water heater systems.

SUMMARY OF THE INVENTION

According to the invention, there is provided a system for distributing tempered fluid to a consumer. The system consists of a storage tank having heating means, outlet means for conveying heated fluid from the storage tank to the distribution system on demand, cold fluid inlet means for replenishing the storage tank on demand, and a heat exchanger which links the outlet means and the cold fluid inlet means. On passing through the heat exchanger, heat energy from the hot fluid in the outlet means is dissipated and transferred by the indirect contact with the cold fluid inlet means, resulting in cooling of the hot fluid exiting the storage tank and warming of the cold fluid entering the storage tank.

Preferably, a water temperature sensor is located in the outlet means between the heat exchanger and the distribution system, which actuates a safety valve to avoid the exiting of fluid above a desired maximum temperature into the distribution system.

Preferably, a temperature sensor will activate one or more bypass valves to cause either the hot fluid outlet or the cold fluid inlet to bypass the heat exchanger where fluid exiting into the distribution system is below a fixed minimum temperature level.

DETAILED DESCRIPTION OF THE PREFERRED EMBODIMENTS

For illustration purposes, specific embodiments of the invention will be described in association with a standard electrically heated domestic hot water delivery system having two immersed elements. A modification of the invention for use in association with hot water delivery systems utilising other types of fuels, such as natural gas, propane, oil, etc., will also be described. Other modifications of the invention for use with other types of domestic hot water delivery systems, such as externally-mounted electric heating elements and one element tanks, and with commercial and industrial systems for delivery of hot water or other types of heated fluid will be obvious to one skilled in the art.

Figure 1A:
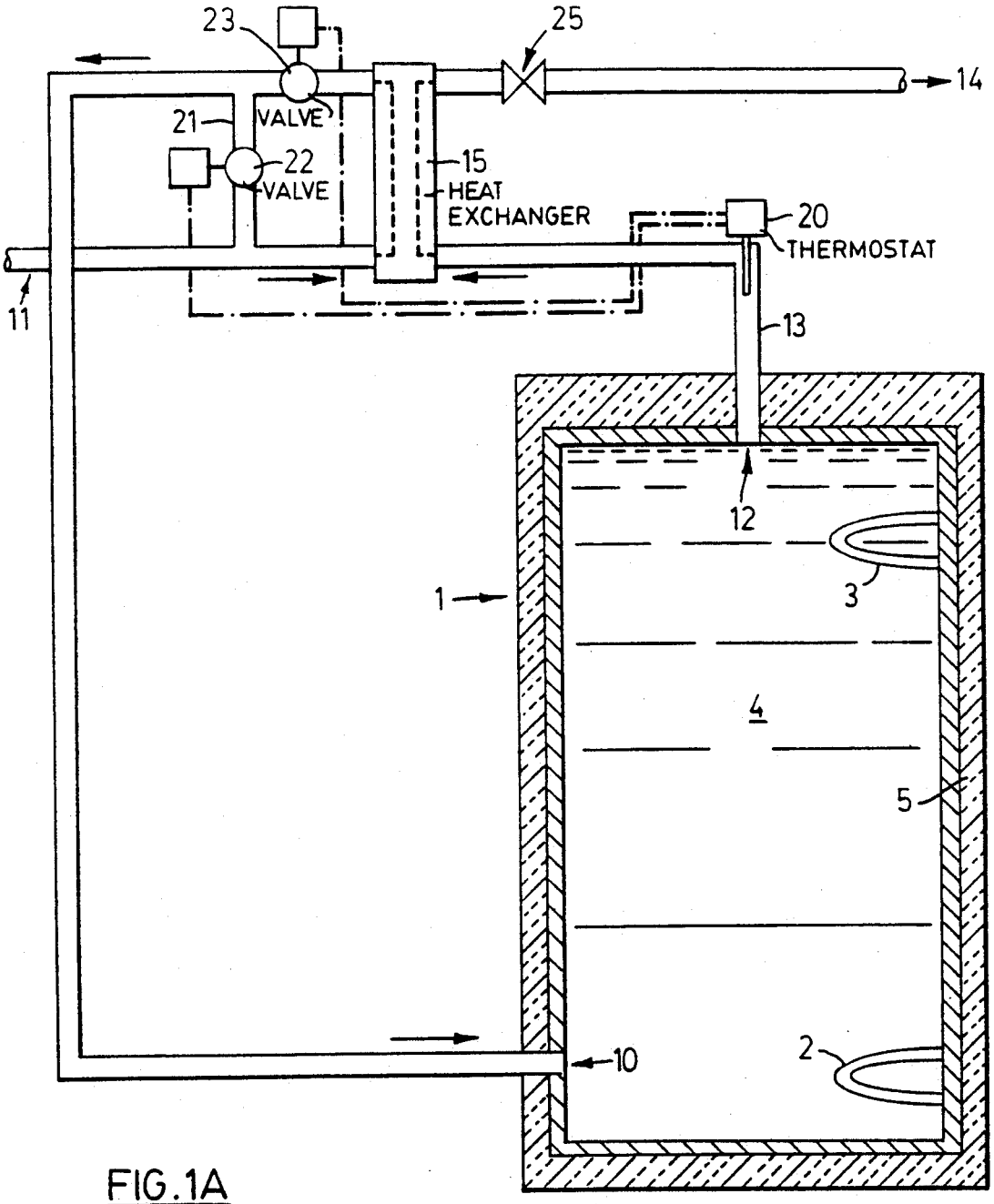
FIGS. 1A, 1B and 1C are schematic illustrations of three embodiments of an electrically-operated water tempering system, according to the invention.
Figure 1B:
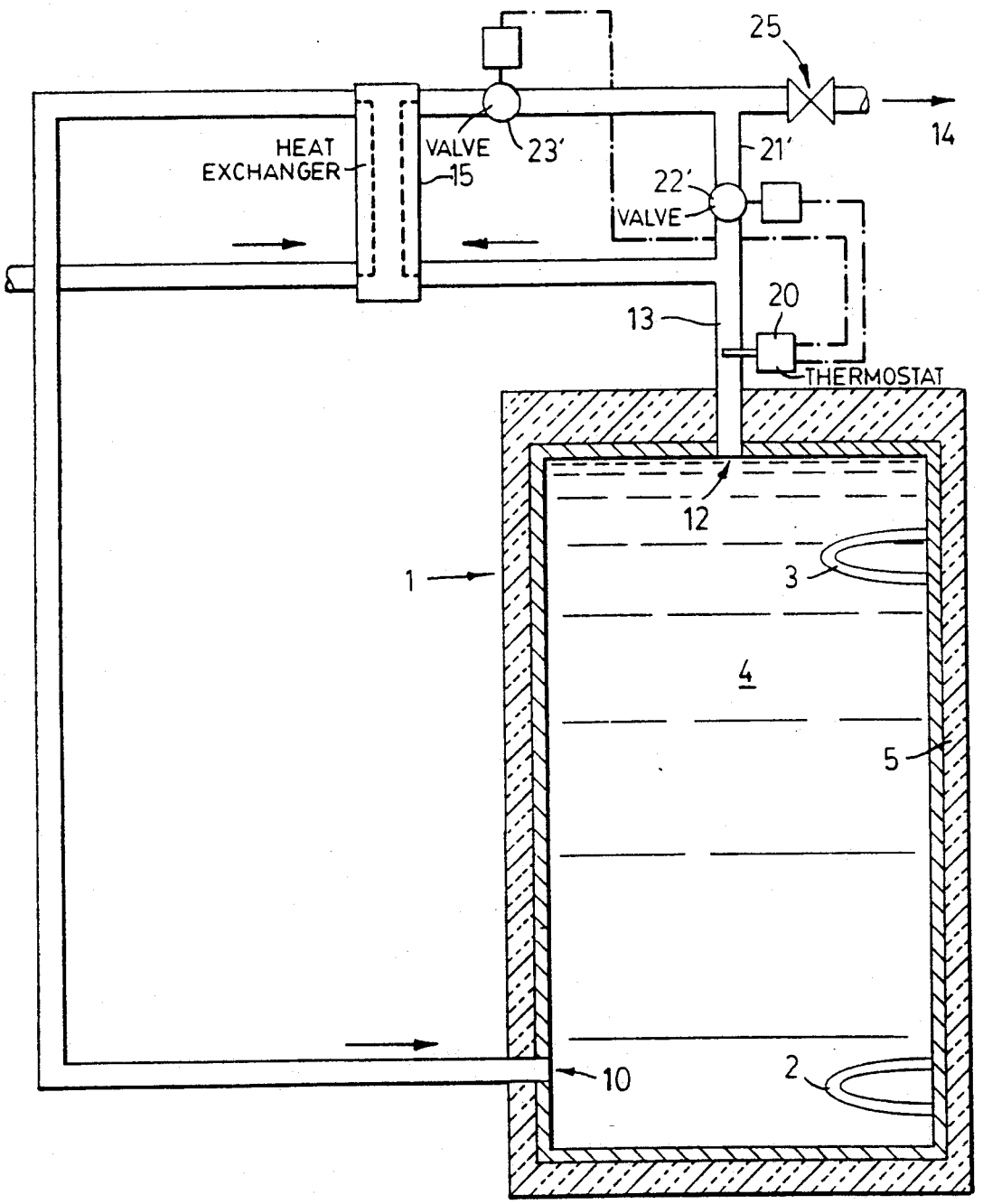
Figure 1C:
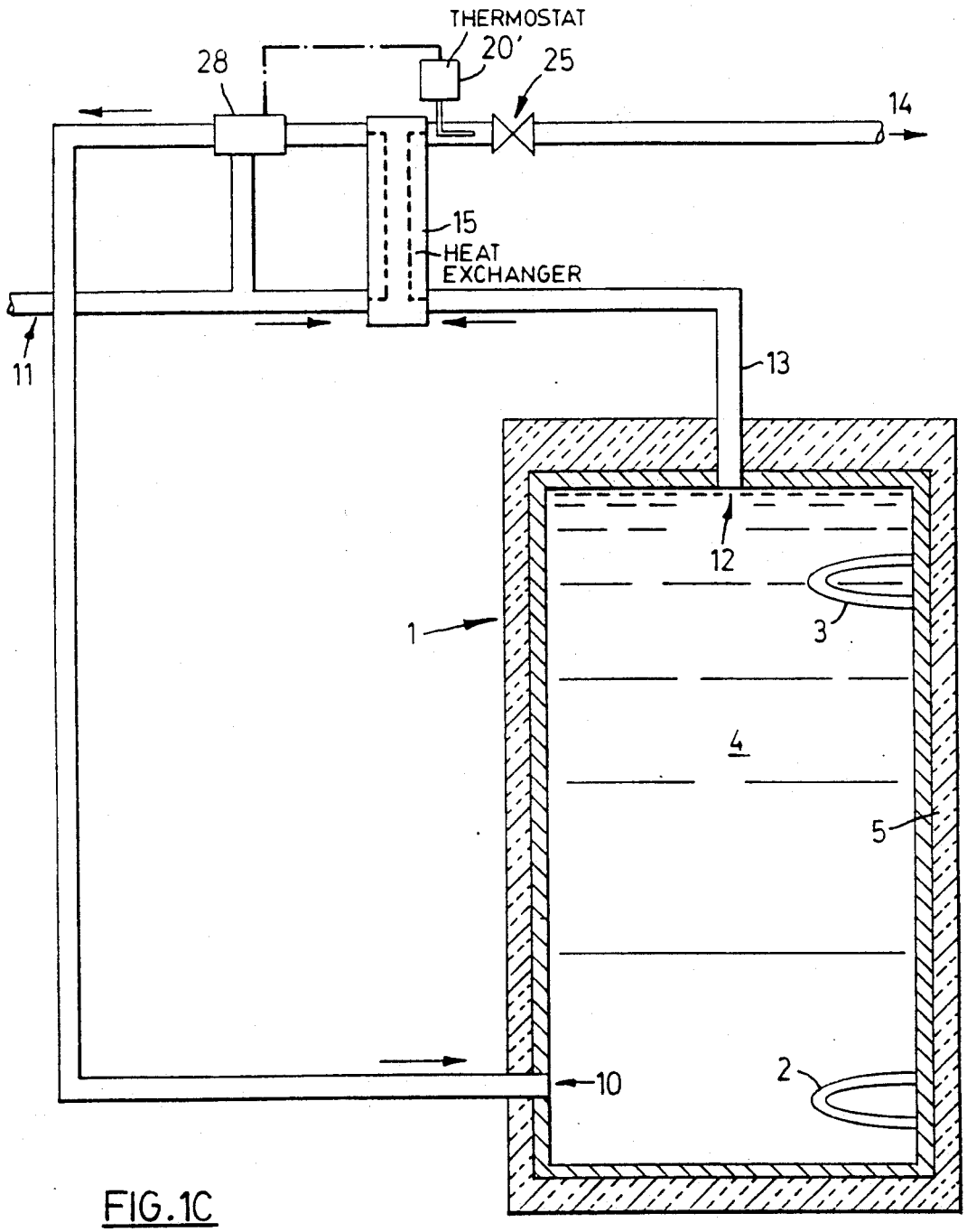

As shown in FIGS. 1A, 1B and 1C, a water storage tank 1 is provided with heating elements 2 and 3 located toward the bottom and top of the tank, respectively, and which are electrically operated in order to heat a body of water 4 in the tank. In standard North American water heaters, the circuit is designed to permit the heating elements to operate in the alternative only, that is, when one element is on, the other is off. As illustrated in FIG. 4, this is done by connecting the elements 2 and 3 to a common power source 30 with a double-throw or flip-flop relay 32.

In conventional constructions for domestic use, the tank 1 is encased in an insulating material 5, such as glass fibre, in order to prevent heat dissipation of the heated water 4 stored therein. For the purposes of the present invention, especially where for power demand control options a circuit interrupter is connected to one of the heating elements, as shown in FIG. 4 and discussed below, a higher level of thermal insulation may be considered to reduce heat loss during peak energy demand periods.

The tank 1 is fed by cold water inlet 10 connected from a source of cold water through conduit 11, and water heated by elements 2 and 3 exits the storage tank on consumer demand through outlet 12 which is connected by hot water conduit 13, to a distribution system 14.

Figure 2B:
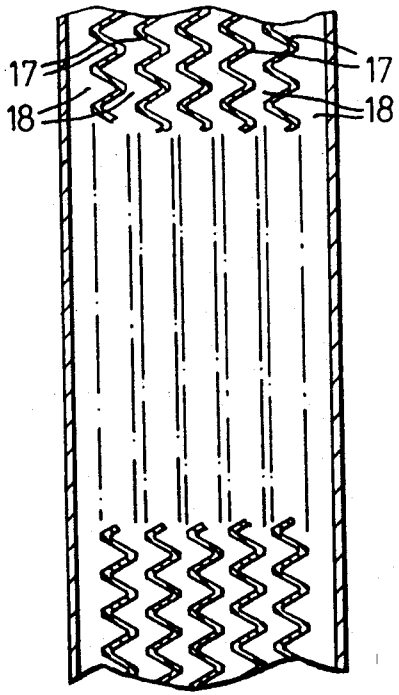
FIGS. 2A and 2B are cross-sectional schematic illustrations of a preferred form of heat exchanger for use in the system of the invention.
Figure 2A:
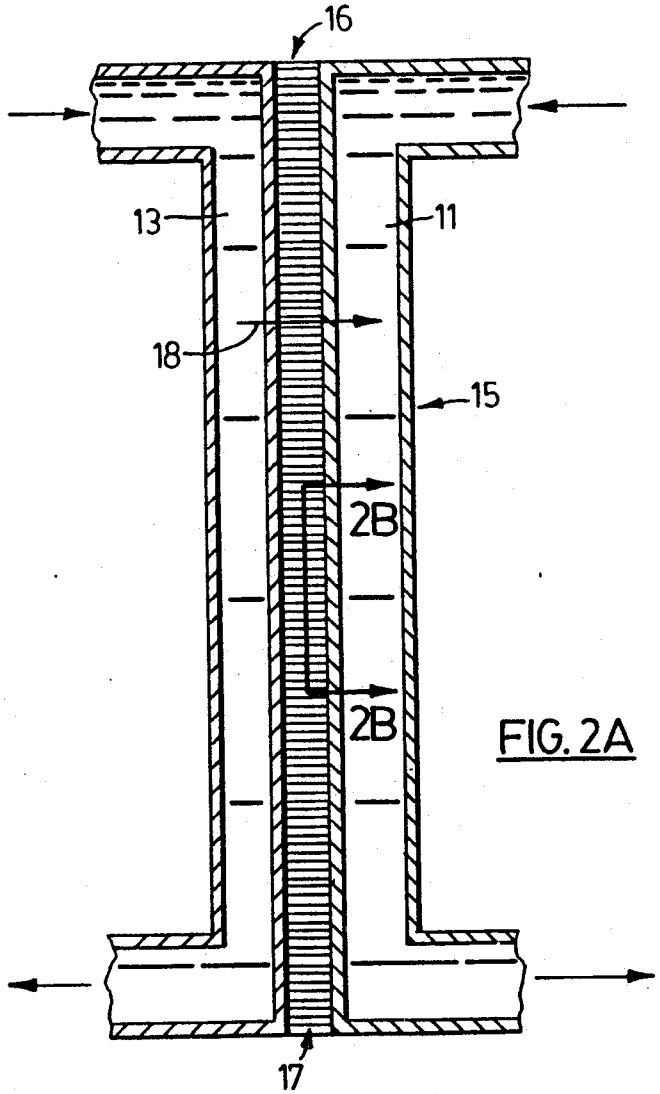

A heat exchanger 15 is interposed between the inlet conduit 11 and the outlet conduit 13. A preferred heat exchanger for use in the system of the present invention, as illustrated in FIG. 2A, provides a heat conduction medium 16 for transferring heat energy between the cold water inlet 11 and hot water conduit 13, so that the two fluid-containing conduits do not actually come into direct contact, but are spaced apart. The heat conduction medium 16 could be comprised, for example, of a stack of thin corrugated metal plates 17, as illustrated in FIG. 2B. Channels 18 formed between the plates 17 and between the conduits 11 and 13 permit the flow of fluid from the conduits 11 and 13, between the plates 17, thus allowing heat to be transferred from the fluid in conduit 13 to the fluid in conduit 11 through the plates 17. The preferred flow of the fluids, for the system of the present invention, in conduits 11 and 13 is through the channels 18 in the same direction (co-current). One advantage of a heat exchanger as described is that it operates over variable water flow rates to effect heat transfer and yield a substantially uniform result in water exiting the heat exchanger in both conduits. A commercially available example of a suitable compact heat exchanger is a brazed heat exchanger sold by Alfa-Laval.

As a consequence of travelling through the heat exchanger, the hot water in conduit 13 is tempered, and a portion of its heat energy is transferred to warm the incoming cold water in conduit 11. Preferably, the heat transfer is complete and the water exiting the heat exchanger in both conduits is of uniform temperature.

In order to prevent excessive cooling of the hot water exiting the hot water tank, a thermostat 20 is inserted in the outlet conduit 13 between the tank 1 and the heat exchanger 15 to sense the temperature of water immediately exiting the hot water tank 1, as shown in FIGS. 1A and 1B.

Where the water temperature at thermostat 20 falls below a set minimum level, a heat exchanger bypass will be activated to avoid either the cold water or hot water flow passing through the heat exchanger.

In the embodiment shown in FIG. 1A, a bypass conduit 21, located on the cold water conduit 11, is opened by bypass valve 22 while valve 23 closes the primary conduit 11 through the heat exchanger 15. Valves 22 and 23 are simultaneously actuated by temperature sensor 20.

In the embodiment shown in FIG. 1B, the bypass conduit 21' is located on the hot water conduit 13 and is opened by valve 22' while valve 23' closes the primary conduit 13 through the heat exchanger 15. Valves 22' and 23' are, in this embodiment, simultaneously actuated on receiving a signal from temperature sensor 20, or a temperature sensor may be incorporated into valve 22' for operation of that valve.

For illustration purposes, valves 22 and 23 (22' and 23'have been shown as separate units in FIGS. 1A and 1B. However, these valves could easily be combined into a single modulating or swinging valve as shown at 28 in FIG. 1C.

In FIG. 1C, temperature sensor 20' is located on the outlet conduit 13 between the heat exchanger 15 and the distribution system 14, and actuates a modulating bypass valve 28 which operates to partially open each of the primary conduit 11 through the heat exchanger 15 and bypass conduit 21, in the ratio needed to temper the water flowing through conduit 13, so that water of a set even temperature will exit to the distribution system 14 at all times. Similarly, the embodiment illustrated in FIG. 1C could be modified to remove the thermostat sensor 20 to a location between the heat exchanger 15 and the distribution system 14.

An exterior signal, such as a light (not shown), could also be associated with either the temperature sensor 20 (20') or one of the bypass valves to indicate, by visual inspection, when the bypass is being operated, and therefore, when the water in the storage tank or system is below scalding temperatures.

As an additional safety feature to prevent scalding water entering the distribution system, an independent safety shut-off valve 25 is located in the hot water conduit 13 between the heat exchanger 15 and the distribution system 14.

Figure 3:
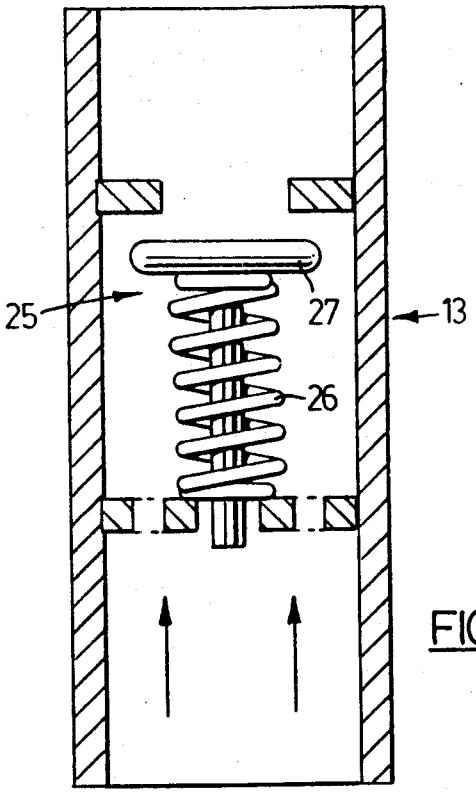
FIG. 3 is a cross-sectional view of a safety shut-off valve for use in the system of the invention.

In the preferred embodiment of the safety shut-off valve 25 illustrated in FIG. 3, a temperature-activated memory alloy is used to form spring 26. Where the spring 26 in the safety valve 25 senses water over a maximum temperature, it automatically expands to move valve member 27 to a position closing the conduit 13, to prevent scalding water exiting the system.

Such a memory alloy is used in the spring of a safety shut-off valve manufactured by Memory Plumbing Products in Connecticut, U.S.A. and sold commercially under the trademark SHOWER GUARD.

In an alternative embodiment (not shown) the thermostat is combined with a solenoid in a known manner for a safety shutoff valve.

When utilising a high temperature water storage system with a properly insulated storage tank, according to the invention, the energy required for re-heating the water in the storage tank can be greatly reduced. According to a further aspect of the present invention, the power supply demand for the heating means of the storage tank can be reduced significantly or completely during lengthy periods of time, such as daily peak energy consumption periods.

Figure 4A:
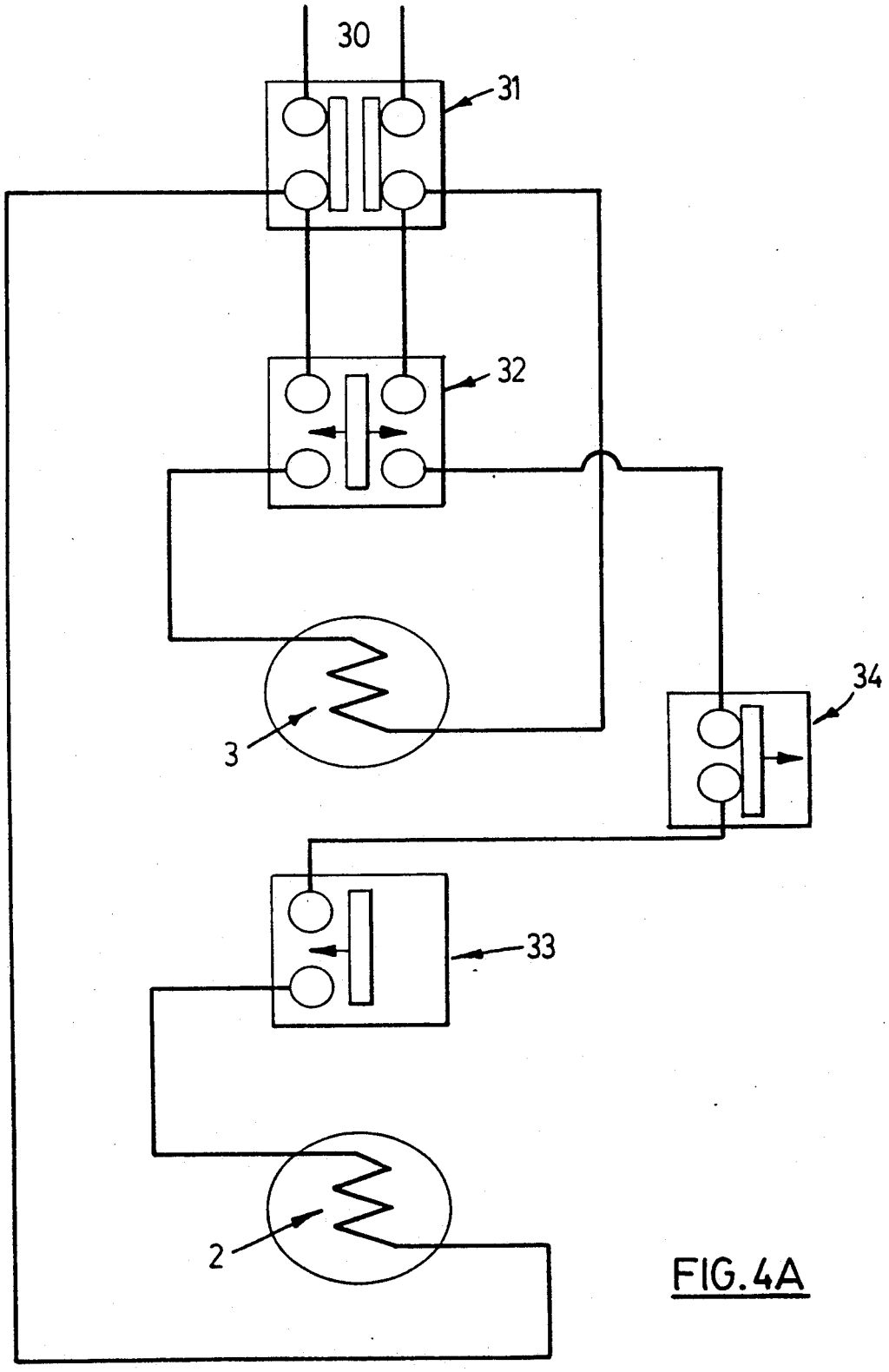
FIG. 4A is a schematic block diagram of an electric water heater system according to the invention.

FIG. 4A illustrates, in schematic block diagram form, a standard North American electrical water heating system, as modified according to the present invention.

A power supply 30 is connected through a high temperature limit control thermostat 31, which automatically shuts off the power supply 30 on sensing water in the tank (not shown) exceeding a set maximum limiting temperature. This maximum limiting temperature in domestic hot water supply systems will be determined by government standards. In North America, standards for domestic water heaters are generally set between 90° and 96° C. (194° and 205° F.), while for commercial systems not subject to such controls, the maximum limiting temperature could be even higher where the tank has been constructed of suitable material, the risk of scalding being addressed by other aspects of the invention described herein.

The power connection to the heating elements 2 and 3 is through a double-throw or flip-flop relay 32 which incorporates a thermostat to open a connection with one of the heating elements when the temperature of the water in the tank falls below a set minimum, generally a tepid set point of 50° to 60° C. (122° to 140° F.).

Only one of heating elements 2 or 3 will be activated at a time. Element 3 will normally be operated until water in the tank is heated to the set point of thermostat 32. The thermostat will then activate the relay in 32 to disconnect the power source to element 3, and provide power to thermostat 33.

According to the invention, a demand control device in the form of a circuit interrupter relay 34, normally closed, connects relay 32 to the lower thermostat 33. When closed, the circuit interrupter enables operation of thermostat 33 to sense the temperature of water in the storage tank around element 2, and to activate the element 2 if the temperature of the water falls below the set minimum, generally a tepid 50° to 60° C. (122° to 140° F.). When open, then, the circuit interrupter 34 disables thermostat 33, and indirectly prevents activation of element 2.

Figure 4B:
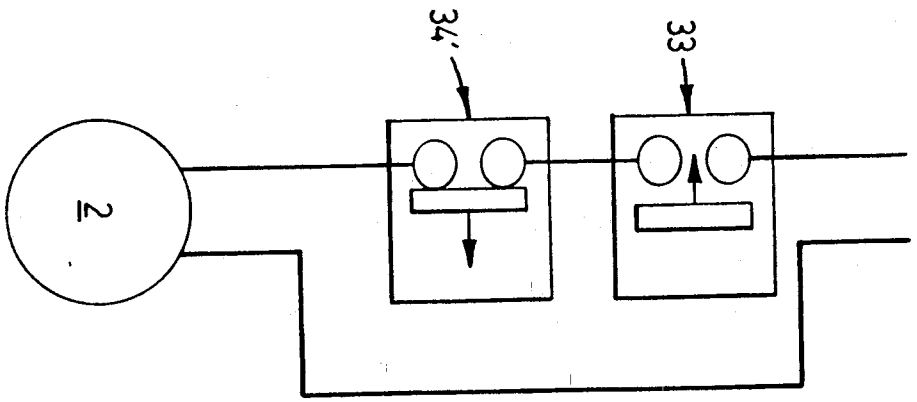
FIG. 4B is a schematic block detail diagram of a modification of the system shown in FIG. 4A.

According to another aspect of the invention illustrated in FIG. 4B, the circuit interrupter 34' is located between thermostat 33 and element 2.

When the circuit interruptor 34 is closed, heating element 2 may be activated, by power received through relay 32, until water in the tank is heated to the set point of thermostat 33. However, opening circuit interrupter 34' disables element 2 by directly shutting off its power source.

The circuit interrupter 34 (34') could either comprise a clock-operable timer or a remote control device, such as an FM radio, or a power line signal-activated switch. A single remote control transmitter could be used to open or close the circuit interrupters 34 (34') for a number of systems, for example, over the area of an entire subdivision, and could be activated to reduce energy consumption over, for example, peak energy demand periods.

Figure 5:
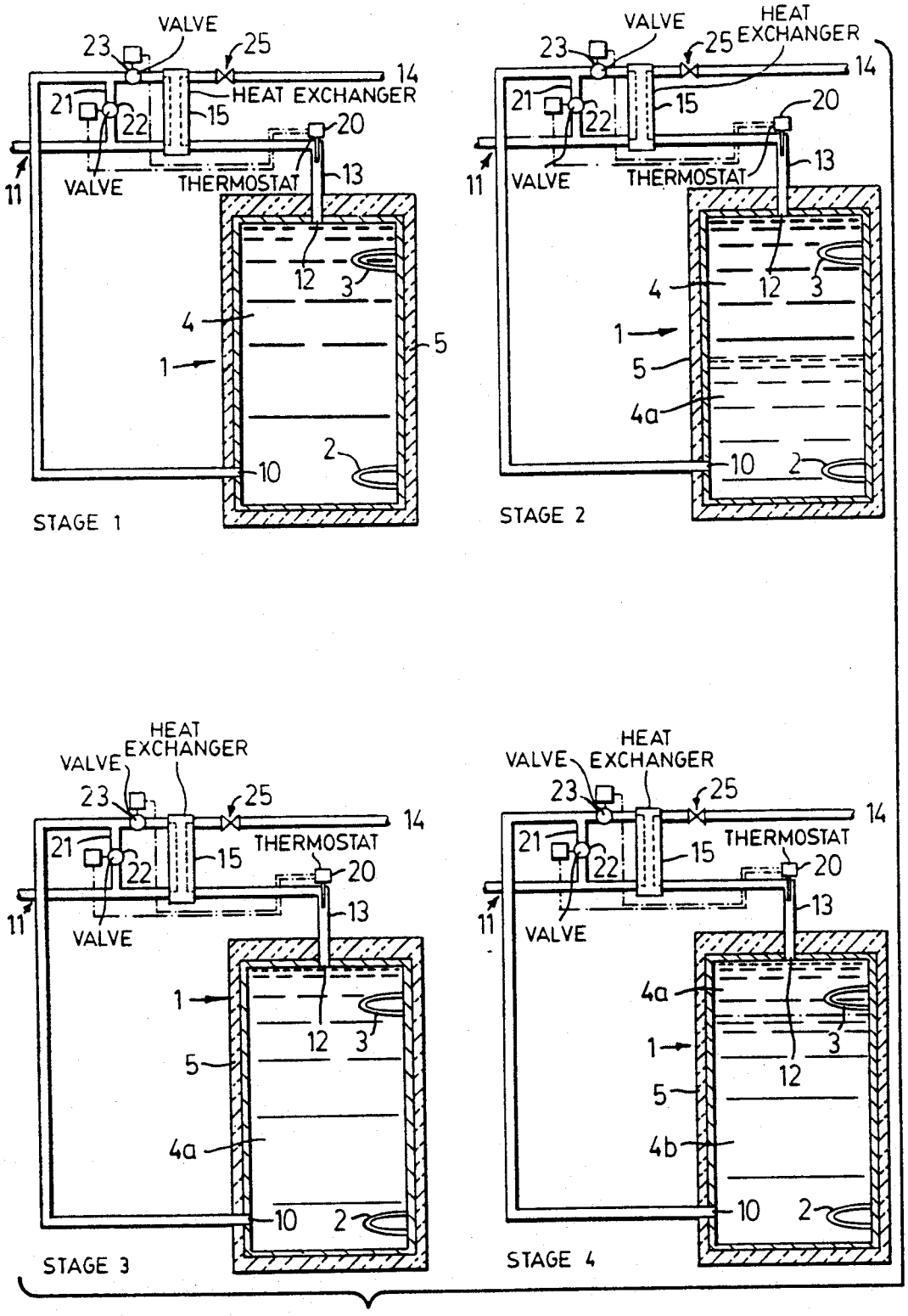
FIG. 5 is a series of four schematic illustrations showing different stages of a system in use according to the invention.

FIG. 5 shows a series of four schematic diagrams to illustrate over a time sequence, features of the inventions as a result of using a circuit interrupter 34 (34') as described above associated with one of the elements, preferably the bottom element 2, to control energy consumption.

In stage 1 of FIG. 5, a tank is illustrated in use during off-peak energy demand hours when both bottom and top elements 2 and 3 are operated in tandem, as water temperature in the tank requires. Preferably, the water 4 in tank 1 may be maintained at 90° to 95° C. (194° to 203° F.), or higher with appropriate tank construction, during these time periods. Therefore, the necessity for tempering the water before distribution to a user can be clearly seen.

Stages 2 and 3 illustrate sequential steps likely to occur during both peak and off-peak energy consumption where a substantial draw on the tank rapidly depletes the scalding water content 4 before it can be re-heated, and only temperate water **4*a*** is left in the tank.

In the situation illustrated in stage 3, only tepid water **4*a* will be drawn, and to avoid further cooling, the heat exchanger bypass at 21** is activated.

Similarly, stage 4 of FIG. 5 illustrates a situation during peak consumption where the bottom element 2 is disengaged, and only the top element 3 is operational to heat the water 4. In rapid draw situations, a shallow body of tepid water **4*a* will continue to be heated around top element 3 for immediate consumption, while the remaining water 4*b* will be at the temperature of the incoming cold water. Again, the heat exchanger bypass 21 must be activated to avoid further cooling of the outgoing tepid water 4*a***.

Figure 6:
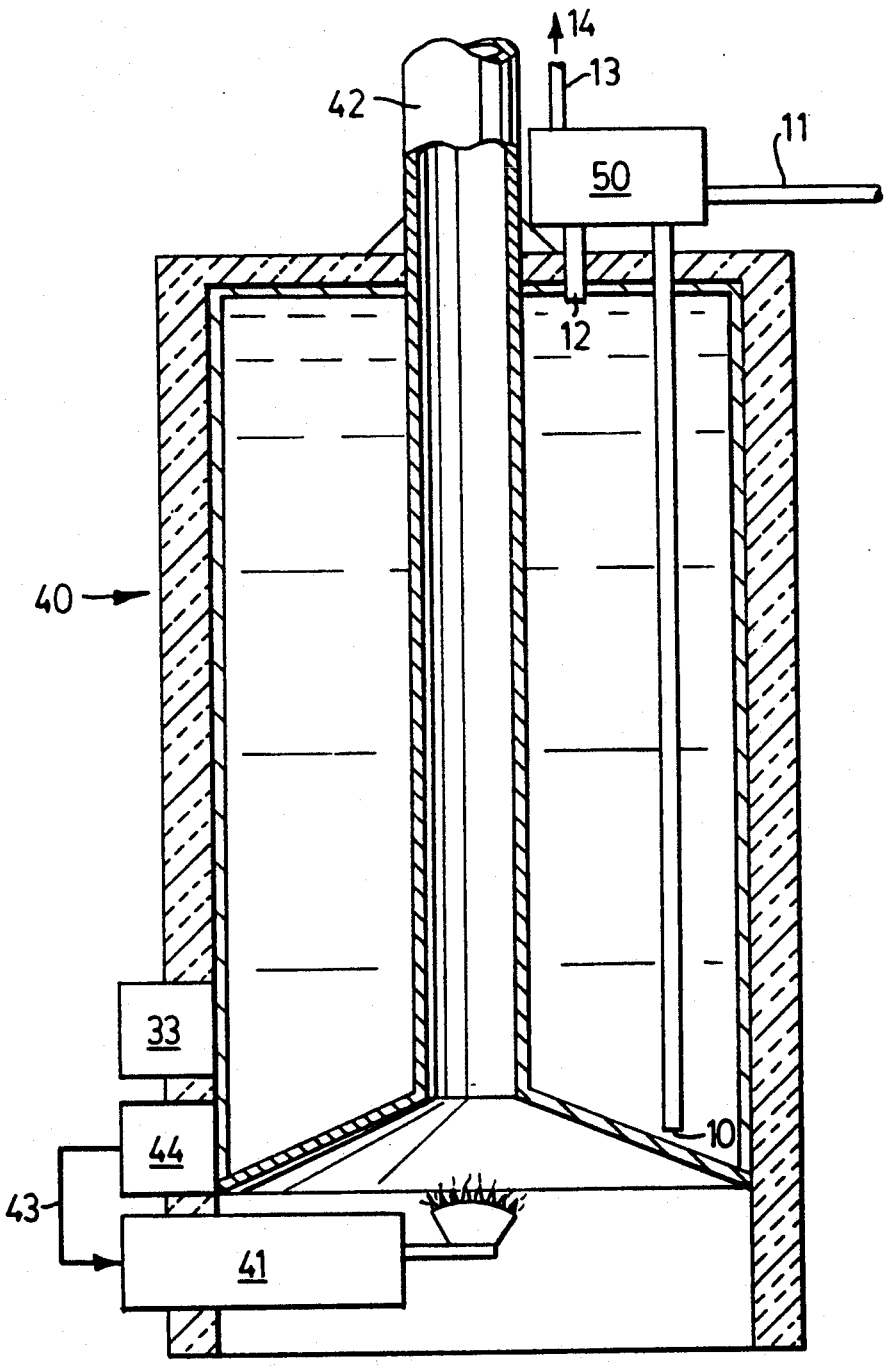
FIG. 6 is a schematic illustration of a fuel fired water heater, according to the invention.

FIG. 6 illustrates a standard domestic hot water heater 40 operated by a single combustion fuel-fired burner 41 located at the bottom of the tank, and vented at 42, the tempering system according to the invention being shown generally as 50. In association with this type of system, the demand control device 44 may comprise means to disconnect the burner 41 from the source 43 of the combustion fuel (i.e., natural gas, oil, propane, etc.), such as a valve (not shown) normally open, but closed by a switch operated either locally or remotely, as described above in relation to FIGS. 4A and 4B.

Studies have shown that an average family of four will consume about 227 litres (60 U.S. Gal.) of hot water per day. Therefore by using a standard water heater of 175 to 360 litres (46 to 95 U.S. Gal) storage capacity for example in association with the present invention, hot water supply can be increased by as much as 50%, since during the initial stages, incoming cold water will be warmed to at least an equal tepid temperature as the outgoing ho&: water, without activating the bottom element 2, before activation of the heat exchanger bypass conduit is required. This should satisfy the hot water demand for any family size.

Obvious modifications of the above system are intended to be covered within the scope of the appended claims.

We claim:

1. A fluid tempering system, comprising:

a storage tank having heating means;

outlet means for conveying heated fluid form the storage tank to a distribution system on demand;

cold fluid inlet means for replenishing the storage tank on demand;

means for transferring heat energy between heated fluid exiting and cold fluid entering the storage tank, without fluid communication between the outlet means and the cold fluid inlet means;

a fluid temperature sensor located in the outlet means; and means to bypass the means for transferring heat energy on receiving a signal from the fluid temperature sensor indicating a heated fluid temperature below a set minimum level.

2. A fluid tempering system, according to claim 1, wherein the fluid temperature sensor is located between the heat energy transfer means and the distribution system.

3. A fluid tempering system, according to claim 2, further comprising a safety shut-off valve located in the outlet means, said valve being actuated to close the outlet means by the fluid temperature sensor indicating a heated fluid temperature over a set maximum level.

4. A fluid tempering system, according to claim 3, wherein the fluid temperature sensor is located in the safety shut-off valve.

5. A fluid tempering system, according to claim 2, wherein the outlet means comprises a primary conduit passing through the heat energy transfer means, a secondary conduit bypassing the heat energy transfer means and a bypass valve means normally opening the primary conduit and closing the secondary conduit to heated fluid exiting the storage tank, the bypass valve means being adapted to close the primary conduit and open the secondary conduit to heated fluid exiting the storage tank on receiving a signal from the fluid temperature sensor indicating a heated fluid temperature below a set minimum level.

6. A fluid tempering system according to claim 5, wherein the fluid temperature sensor is located in the bypass valve.

7. A fluid tempering system, according to claim 5, wherein the fluid temperature sensor is located between the storage tank and the heat energy transfer means.

8. A fluid tempering system, according to claim 5, wherein the fluid temperature sensor is located in the outlet means between the heat energy transfer means and the distribution system, and wherein the bypass valve means comprises a modulating bypass valve adapted to partially close the primary conduit and partially open the secondary conduit on receiving a signal from the temperature sensor indicating a heated fluid temperature below a set minimum level.

9. A fluid tempering system according to claim 2, wherein the inlet means comprises a primary conduit passing through the heat energy transfer means, a secondary conduit bypassing the heat energy transfer means and a bypass valve means normally opening the primary conduit and closing the secondary conduit to cold water, the bypass valve means being adapted to close the primary conduit and open the secondary conduit to cold fluid on receiving the signal from the fluid temperature sensor indicating a heated fluid temperature below a set minimum level.

10. A fluid tempering system, according to claim 9, wherein the fluid temperature sensors located between the storage tank and the heat energy transfer means.

11. A fluid tempering system, according to claim 9, wherein the fluid temperature sensor is located in the outlet means between the heat energy transfer means and the distribution system, and wherein the bypass valve means comprises a modulating bypass valve adapted to partially close the primary conduit and partially open the secondary conduit on receiving the signal from the temperature sensor indicating a heated fluid temperature below a set minimum level.

12. A water tempering system, according to claim 1, wherein the heating means is adapted to heat fluid in the storage tank to scalding temperatures.

13. A fluid tempering system, according to claim 1, wherein the heating means comprises an upper and a lower heating element in the storage tank, and connection means between said heating elements and a power source, the connection means including a split switch connecting the heating elements to the power source, whereby the heating elements can be activated alternatively only.

14. A fluid tempering system, according to claim 13, wherein the heating means further comprises means to disconnect the lower heating element from the power source during selected time periods.

15. A fluid tempering system, according to claim 1, wherein the heating means comprises a burner utilizing combustible fuel, and means to disconnect the burner from its fuel source during selected time periods.

16. A fluid tempering system, according to claim 1 wherein the heating means further comprises:

at least one thermostatically-controlled switch adapted to operate the heating means when fluid in the storage tank is at a temperature below a set minimum; and means to disable the thermostat during selected time periods.

17. A fluid tempering system, according to claim 1, wherein the outlet means comprises a primary conduit passing through the heat energy transfer means, a secondary conduit bypassing the heat energy transfer means and a bypass valve means normally opening the primary conduit and closing the secondary conduit to heated fluid exiting the storage tank the bypass valve means being adapted to close the primary conduit and open the secondary conduit to heated fluid exiting the storage tank, on receiving a signal from the fluid temperature sensor indicating a heated fluid temperature below a set minimum level.

18. A fluid tempering system according to claim 1, wherein the inlet means comprises a primary conduit passing through the heat energy transfer means, a secondary conduit bypassing the heat energy transfer means and a bypass valve means normally opening the primary conduit and closing the secondary conduit to cold water, the bypass valve means being adapted to close the primary conduit and open the secondary conduit to cold fluid on receiving a signal from the fluid temperature sensor indicating a heated fluid temperature below a set minimum level.

* * * * *

UNITED STATES PATENT AND TRADEMARK OFFICE

CERTIFICATE OF CORRECTION

PATENT NO. : 5,115,491

DATED : May 19, 1992

INVENTOR(S) : Maier Perlman, et. al.

It is certified that error appears in the above-indentified patent and that said Letters Patent is hereby corrected as shown below:

On the Title page, item

In the description of the first inventor at reference [76], after "Thornhill," insert -- Ontario, --.

In the first line of the abstract, delete "tampering" and replace with -- tempering --.

At column 4, line 48, delete "Memory" and replace with -- Memry --.

Signed and Sealed this

Seventeenth Day of August, 1993

Bruce Lehman

*Attest:*

BRUCE LEHMAN

*Attesting Officer*

*Commissioner of Patents and Trademarks*